United States Patent [19]

Johnson

[11] Patent Number: 5,018,626

[45] Date of Patent: May 28, 1991

[54] CURTAIN ROD AND END BRACKET ASSEMBLY

[75] Inventor: Daniel C. Johnson, Madison, Wis.

[73] Assignee: Graber Industries, Inc., Middleton, Wis.

[21] Appl. No.: 482,343

[22] Filed: Feb. 20, 1990

[51] Int. Cl.[5] ..... A47H 1/10

[52] U.S. Cl. ..... 211/105.1; 248/265; 16/94 R

[58] Field of Search ..... 248/265, 261, 262, 269, 248/257, 251, 254, 201; 403/295, 291; 211/105.1, 105.3, 182; 24/614, 615, 616, 605, 607; 16/94 R; 160/902

[56] References Cited

U.S. PATENT DOCUMENTS

| | | | |
|---|---|---|---|
| 1,375,805 | 4/1921 | Umphrey . | |
| 1,591,209 | 7/1926 | Boye . | |
| 1,816,824 | 8/1931 | Brunner | 248/262 |
| 2,522,288 | 9/1950 | Light | 248/265 |
| 4,653,564 | 3/1987 | Marocco . | |
| 4,694,532 | 9/1987 | Black . | |
| 4,824,062 | 4/1989 | Wagner . | |

FOREIGN PATENT DOCUMENTS 1396 of 1902 United Kingdom .

*Primary Examiner*—Carl D. Friedman
*Assistant Examiner*—Korie Chan
*Attorney, Agent, or Firm*—Vernon J. Pillote

[57] ABSTRACT

A curtain rod and bracket assembly in which the rod sections have a front wall and upper and lower U-shaped flanges extending lengthwise along the rear side of the front wall. Rod end brackets are provided for supporting the ends of a rod section and the rod end brackets are adjustable to vary the angle of projection of the rod end brackets relative to the surface on which the bracket is mounted, and to also adjust the angle at which the rod extends relative to the end bracket, for use in bay and bow windows. A curtain rod connector is formed with end panels adapted for insertion into endwise adjacent rod sections and resilient tabs at one edge of the end panels for engagement with a flange on the curtain rod to hold the curtain rod and connector in assembled relation.

14 Claims, 2 Drawing Sheets

Fig. 4.
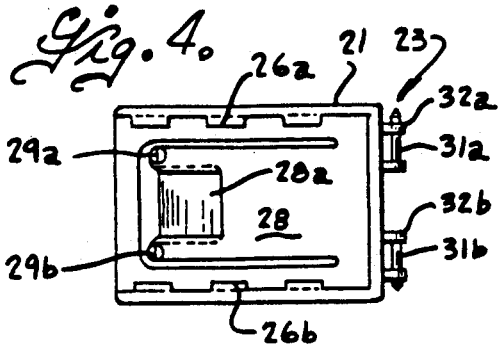
Fig. 5.
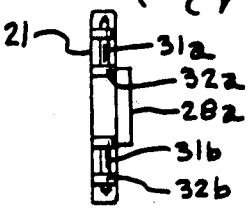
Fig. 7.
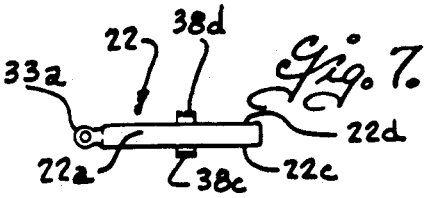
Fig. 8.
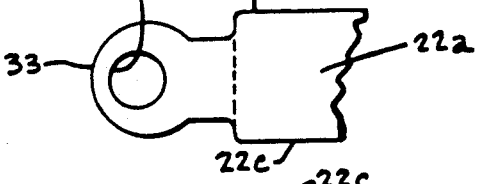
8 8
Fig. 6.
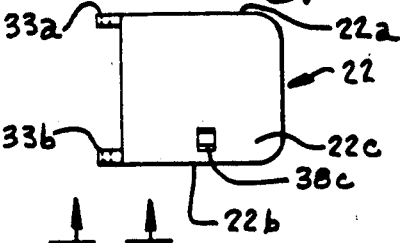
9 9
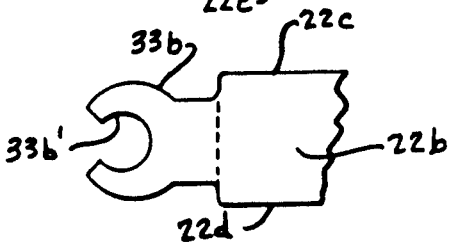
Fig. 9.
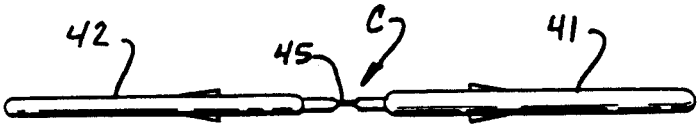
Fig. 10.
Fig. 13.
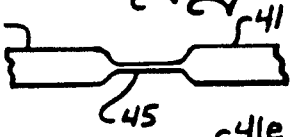
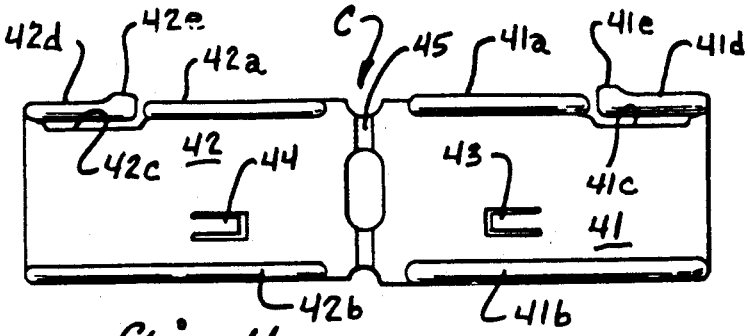
Fig. 11.
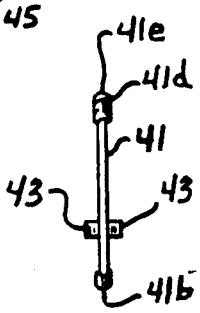
Fig. 12.

CURTAIN ROD AND END BRACKET ASSEMBLY

BACKGROUND OF THE INVENTION

Various curtain rod and bracket assemblies have heretofore been used in bay and bow installations. It is common practice to independently mount conventional curtain and valance rods having fixed end returns or wall brackets on each of the windows in the bay. It is also known as disclosed in U. K. Pat 1396, to pivotally support adjacent ends of several rod sections on intermediate rod support brackets located between adjacent windows in the bay, to allow the rod sections to extend at an angle to each other and generally parallel to the windows in the bay. Curtain rod and bracket assemblies have also been made for bay windows, for example as disclosed in U.S. Pat. Nos. 1,375,805; 1,591,209; 4,653,564 and 4,694,532, in which adjacent ends of the several rod sections were connected by rod connectors that were either bendable or hinged to allow the rod sections to extend at an angle to each other and generally parallel to the several windows in the bay. However, the window frames and walls of the bay frequently intersect the main wall of the building at an angle other than 90° and, when the prior curtain rod end bracket assemblies were installed in the bay, the ends of the rods and the rod end brackets would project beyond the plane of the wall and into the room.

SUMMARY OF THE INVENTION

It is an object of this invention to overcome the disadvantages of the prior art by providing a curtain rod and end bracket assembly which is angularly adjustable for use in conventional window installations in which the rod end bracket extends perpendicular to the rod and also in bay and bow window installations in which the rod end bracket extends at an adjustable angle to the rod.

Another object of this invention is to provide a rod and end bracket assembly in which the same end bracket can be used at either the left or right end of the rod.

A further object of this invention is to provide a curtain rod and end bracket assembly which can be compactly packaged for economy in storage and transportation, and which can be easily assembled and installed.

Still another object of this invention is to provide a curtain rod and bracket assembly having an improved connector for interconnecting adjacent ends of several straight rod sections.

BRIEF DESCRIPTION OF THE DRAWINGS

FIG. 4 is a view of the inner side of a mounting panel forming part of the rod end bracket;

FIG. 5 is an end view of the mounting panel of FIG. 4;

FIG. 6 is a side view of a rod support panel forming part of the rod end bracket;

FIG. 7 is a top view of the rod support panel of FIG. 6;

FIG. 8 is a fragmentary view taken on the plane 8—8 of FIG. 6 showing parts on a larger scale;

FIG. 9 is a fragmentary view taken on the plane 9—9 of FIG. 6, illustrating parts on a larger scale;

FIG. 10 is a top view of a rod connector for connecting ends of endwise adjacent rod sections;

FIG. 11 is a side view of the rod connector of FIG. 10;

FIG. 12 is an end view of the rod connector; and

FIG. 13 is a fragmentary view on a larger scale illustrating a portion of the rod connector.

DETAILED DESCRIPTION

Figures 1, 2, 3:
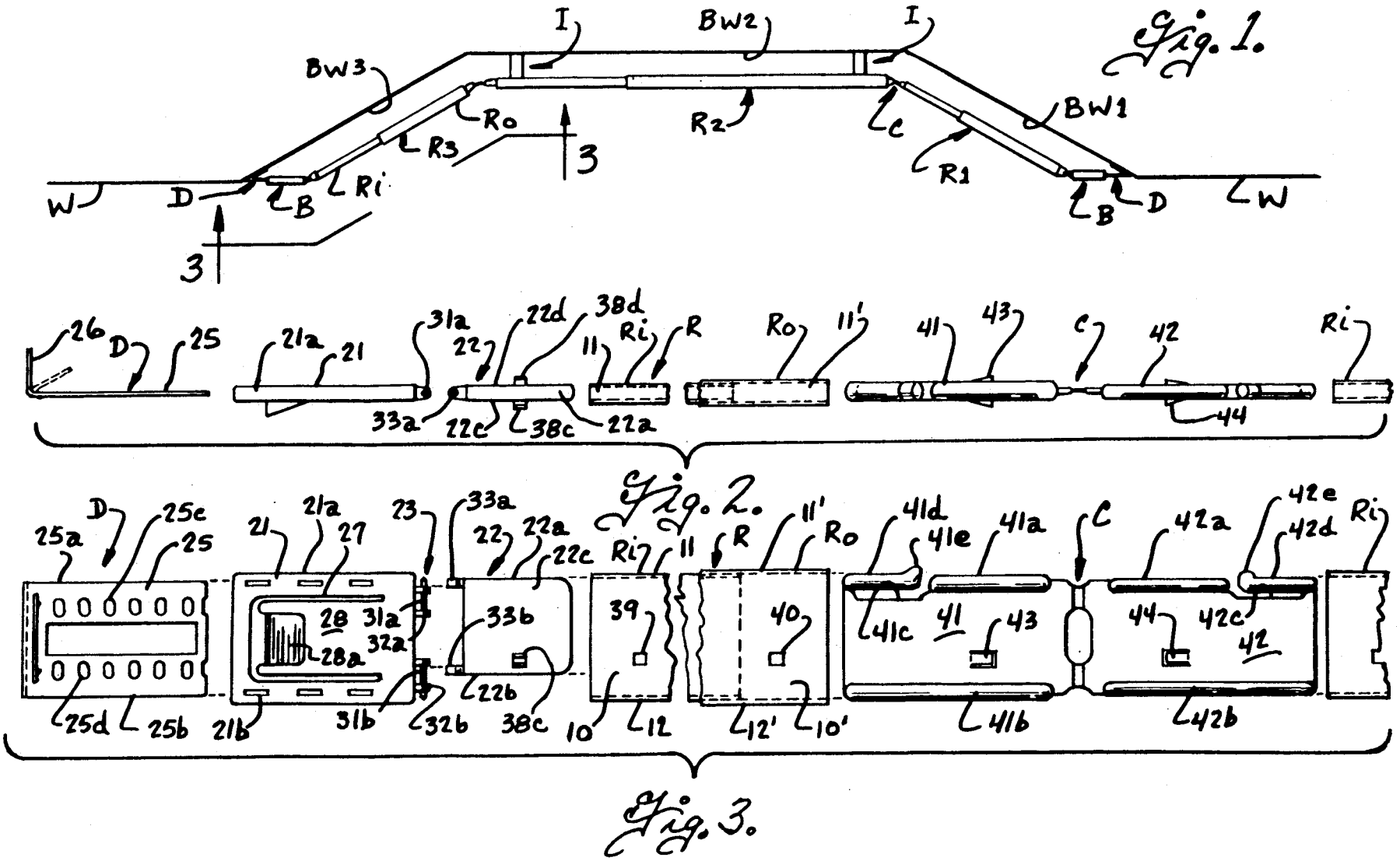
FIG. 1 is a plan view of a bay window installation having the curtain rod and end bracket assembly of the present invention applied thereto.
FIG. 2 is an exploded top view of the rod end bracket, rod section and rod connector.
FIG. 3 is an exploded side view of the rod end bracket, rod section and rod connector.

The curtain rod and bracket assembly of the present invention is particularly adapted for installation in bay and bow windows in which a curved window or a series of windows form a bay or recess in a room and project outwardly from a wall in the room in a rectangular, polygonal or curved form. The curtain rod and bracket assembly is shown in FIG. 1 in a bay window installation with three bay windows designated BW1, BW2 and BW3 that project outwardly from an interior wall W of a room, it being understood that the bay could be formed by only two windows or by more than three windows, or be formed with a single curved or bowed window.

In bay and bow window installations, the rod assembly includes a plurality of straight rod sections herein shown three in number and designated R1, R2 and R3 in FIG. 1 and rod end brackets designated B. As pointed out more fully hereinafter, the rod end brackets B are constructed and arranged so that the same end bracket can be adapted for use at either the left or right end of a rod. The rod end brackets B can be used at both ends of each rod section to individually mount each rod section in the bay. However, in bay and bow window installations, endwise adjacent rod sections are preferably interconnected by connectors C constructed and arranged to allow adjacent rod sections to be disposed at an angle to each other, with intermediate support brackets I provided for supporting the rod assemblY intermediate its ends.

The several rod sections R1–R3 are of like construction and like numerals are used to designate corresponding parts of each of the rod sections. The rod sections each preferably include telescopically adjustable outer and inner rod members Ro and Ri. The inner rod member Ri has a front wall 10 and upper and lower U-shaped flanges 11 and 12 at the rear side of the front wall and the outer rod member Ro similarly has a front wall 10' and a upper and lower U-shaped flanges 11' and 12' at the rear side of the front wall, and the inner rod member is made sufficiently smaller than the outer rod member to be telescopically received therein.

The rod end brackets B each include a generally upright mounting panel 21 and a generally upright rod support panel 22 and a hinge means 23 connecting one end of the rod support panel to one end of the mounting panel for pivotal movement relative thereto about a generally upright pivot axis between a position in which the support panel extends generally lengthwise of the mounting panel and a position in which the support panel extends at an angle to the mounting panel. The mounting panel 21 and rod support panel 22 are preferably molded of synthetic resin material that may, for example, be formed of medium impact ABS, and the hinge means 23 includes hinge pintles advantageously formed integrally with one of the panels and hinge knuckles formed integrally with the other of the panels.

Wall brackets D are provided for attaching the mounting panel 21 of the rod end bracket to a support such as the wall or the frame of a window, and the wall bracket and rod end bracket are constructed and arranged so that the same wall bracket and end bracket can be used at either the left or right end of a rod section or rod assembly. The wall brackets D are preferably similar in construction to those shown in U.S. Pat. No. 4,824,062, assigned to the assignee of the present invention. Each wall bracket D includes a generally upright bracket plate 25 and a mounting flange 26 that extends laterally from one end of the bracket plate. The wall bracket is formed of a bendable metal such that the bracket plate is hand bendable relative to the mounting flange, when the mounting flange is attached to a support surface, to enable adjustment of the angle of projection of the bracket plate relative to the mounting flange. The bracket plate has relatively parallel side edges 25*a*, 25*b* and at least one and preferably two rows of openings designated 25*c* and 25*d* that parallel edges 25*a* and 25*b*. With this construction, the wall bracket D can be mounted on a support surface with either edge 25*a* uppermost for use at the left end of a rod section or with the edge 25*b* uppermost for use at the right end of a rod section.

The mounting panel 21 is preferably similar to the mounting panel disclosed in the aforementioned U.S. Pat. No. 4,824,062. The mounting panel is adapted to overlie the outer side of the bracket plate 25 and has relatively parallel side edges 21*a* and 21*b* and generally L-shaped guide flanges 26*a* and 26*b* along the side edges 21*a* and 21*b* at the rear side of the mounting panel (FIG. 4) and which are arranged to engage the upper and lower edges 25*a* and 25*b* of the bracket plate, to guidably support the mounting panel on the bracket plate. The mounting panels each have a U-shaped slot 27 molded therein intermediate the upper and lower edges 21*a*, 21*b* and which define a tongue portion 28 that is integrally joined at one end to the mounting panel. The tongue portion extends rearwardly on the mounting panel and is normally disposed coplanar therewith, and the tongue has upper and lower bosses 29*a*, 29*b* (FIG. 4) that extend from the distal end of the tongue portion at the inner side of the mounting panel and which are adapted to engage a selected opening in the rows of openings 25*c*, 25*d*. The tongue 28 is formed with a finger receiving tab 28*a* adjacent the distal end thereof and which projects from the outer side of the mounting panel to enable pulling of the distal end of the tongue laterally outwardly relative to the mounting panel to disengage the bosses 29*a*, 29*b* from the openings in the bracket plate. As will be seen, when the wall bracket D is mounted with the edge 25*a* uppermost, for use at the left end of a rod, the edge 21*a* of the mounting panel 21 will be uppermost and conversely, when the wall bracket is mounted with the edge 25*b* uppermost, for use at the right end of a rod, the edge 21*b* of the mounting panel will be uppermost.

The rod support panel 22 of the rod end bracket has upper and lower edges 22*a*, 22*b* and opposite side faces 22*c* and 22*d*. The rod support panel is constructed and arranged to support an end of a rod section when the rod end bracket is installed at either the left or right end of a rod section. In order to enable assembly of the rod section on the rod end bracket from the front, as disclosed in the aforementioned U.S. Pat. No. 4,824,063, when the end bracket is used at either end of the rod section, the hinge means 23 is constructed and arranged to enable the rod support panel 22 to be mounted on the mounting panel 21 with the upper edge 22*a* of the support panel uppermost, when either the upper edge 21*a* or lower edge 21*b* of the mounting panel is uppermost. As best shown in FIGS. 3–6, the hinge means 23 includes a first pintle 31*a* preferably joined integrally by a pair of lugs 32*a* to one end of the mounting panel 21 adjacent the edge 21*a*, and a second pintle 31*b* integrally joined by a pair of lugs 32*b* to an end of the mounting panel adjacent the side edge 21*b*. Pintle 31*a* has a portion intermediate the lugs 32*a* and a cantilevered portion and pintle 31*b* similarly has a portion intermediate the lugs 32*b* and a cantilevered portion. A hinge knuckle 33*a* is formed integrally with one end of the rod support panel 22 adjacent the upper edge 22*a* and a second hinge knuckle 33*b* is formed integrally with one end of the rod support panel adjacent the lower edge 22*b*. As best shown in FIGS. 8 and 9, the hinge knuckle 33*a* has a pintle receiving opening 33*a'* and hinge knuckle 33*b* has a pintle receiving opening 33*b'*. Hinge knuckle 33 is adapted for assembly on the cantilevered pintle portion of either pintle 31*a* or 31*b*, whichever is uppermost, by shifting the rod support panel relative to the mounting panel in a direction axially of the uppermost hinge pintle. The knuckle 33*b* includes knuckle sections having adjacent ends spaced apart a distance less than the diameter of the hinge pintle and such that the second hinge knuckle can be assembled on the lower one of the hinge pintles by relative movement of the panels in a direction radially of the lower hinge pintle, when the knuckle 33*a* is assembled on the cantilevered end of the uppermost hinge pintle. When the rod support panel is assembled on the mounting panel, the upper knuckle 33*a* overlies an upper lug 32*a* and the lower knuckle 33*b* underlies one of the lower lugs 32*b*, to hold hinged panels in assembled relation.

The upper edge on the rod support panel is arranged to extend into the upper flange on the rod member adjacent one end and support the rod member for limited swinging movement about the upper edge toward and away from the face of the rod support panel. When the rod end bracket is mounted at the left end of a rod section, the rod member overlies one face 22*c* of the rod support panel and when the rod support member is used at the right end of the rod member, the rod member overlies the other face 22*d* of the support panel. Latches 38*c* and 38*d* are provided on opposite faces 22*c* and 22*d* of the rod support panel and arranged to extend through latch openings 39 and 40 in the faces of the rod members, to releasably retain the associated rod member against pivotal movement away from the face of the rod support panel.

Since the same rod end brackets and wall brackets can be used at either end of a rod section, it is apparent that each rod section could be independently mounted by using a rod end bracket B at both ends of each section. However, in bay and bow windows it is advantageous to provide connectors C to interconnect endwise adjacent rod sections in a manner to permit relative angular movement between the rod sections. The connector C is preferably formed of a resilient synthetic resin material such as polypropylene and each connector includes two panel portions 41 and 42 adapted to extend into adjacent ends of endwise adjacent rod sections. Panel portion 41 has relatively parallel upper and lower edges 41*a* and 41*b* dimensioned and spaced apart to be received in the upper and lower flanges 11', 12' on the outer rod section Ro and the other panel portion 42 has upper and lower edges 42*a* and flanges 11, 12 on an inner rod section Ri. The panel portion 41 is formed with an area 41*c* that is recessed below the upper edge and a tab 41*d* is integrally joined at one end to the panel 41 and has a distal end 41*e* that normally projects above the upper edge of the panel 41 for resiliently engaging the flange on the associated rod section. Similarly, connector panel 42 has area 42*c* that is recessed below the upper edge and a tab 42*d* integrally joined at one end to the panel 42 and having a distal end 42*e* that normally projects above the upper edge of the panel to resiliently engage a flange on an associated rod section. With this rod construction, the connector can be readily inserted to endwise adjacent rod sections and the tab resiliently engages upper flange on the associated rod section to firmly interconnect the rod sections. Latches 43 and 44 are provided on both sides of the connector panels 41 and 42 at locations to engage an opening 39 or 40 in the adjacent end of the rod member, to hold the rod members in assembled relation. In the embodiment illustrated, the connector panels 41 and 42 are flexibly interconnected by a thin flexible hinge portion 45, to allow angular movement of the connector panels and the associated rod sections relative to each other by a generally upright axis. The intermediate support brackets I are conveniently of the type disclosed on aforementioned U.S. Pat. No. 4,824,062 and are provided to support long rod sections intermediate their ends and also to support one or more of the rod sections adjacent their ends, when the adjacent ends are connected by a connector C.

From the foregoing it is believed that the construction and use of the rod and end bracket assembly will be readily understood. In installing the rod and end bracket assembly, the flanges on the wall brackets are attached to a supporting surface such as the wall or window frame. In bay and bow windows, the mounting flange can be attached to the bay closely adjacent its intersection with the interior wall W of the room, and the wall bracket then bent by hand to extend generally parallel to the wall W. The mounting panel of the rod end bracket can be assembled on the wall bracket either before or after bending of the wall bracket and the rod support panel then assembled on the pintles of the mounting bracket. The rod section is thereafter mounted on the rod support panel and the panel can be angularly adjusted about the hinge 23 so as to extend generally parallel to their respective one of the associate windows of the bay.

As previously described, the rod end brackets are adapted for use on either the left or the right end of a rod section and the rod sections can be individually mounted by using two rod end brackets. Alternatively, when connectors C are used, the connectors can be inserted into the ends of endwise adjacent rod sections and the rod sections thereafter supported on intermediate brackets I.

The embodiments of the invention in which an exclusive property or privilege is claimed are defined as follows:

1. A curtain rod and bracket assembly comprising, at least one elongated rod section having a front wall and upper and lower U-shaped flanges extending lengthwise along a rear side of the front wall, rod end bracket means including a generally upright rod support panel member and a generally upright mounting panel, hinge means connecting one end of the rod support panel to one end of the mounting panel for pivotal movement relative thereto about a generally upright pivot axis between a position in which the support panel extends generally lengthwise of the mounting panel and a position in which the support panel extends at an angle to the mounting panel, the rod support panel having first and second sides and an upper rod support edge, said upper rod support edge being constructed and arranged to extend into the upper flange on the rod section adjacent one end thereof and support the rod section for pivotal movement about the upper edge toward and away from the rod support panel, latch means on the rod support panel spaced below the upper rod support edge and engageable with the rod section when the latter is pivoted about the upper rod support edge into engagement with the rod support panel for releasably retaining the rod section against pivotal movement away from the rod support panel, wall bracket means for attaching the mounting panel to a support, said mounting panel having first and second side edges and said wall bracket means being adapted to attach the mounting panel to a support with either said first or said second side edge of the mounting panel uppermost, said hinge means being constructed and arranged for connecting the support panel to the mounting panel with said upper rod support edge of the support panel uppermost, when either said first or said second side edge of the mounting panel is uppermost.

2. A curtain rod and bracket assembly comprising, at least one elongated rod section having a front wall and upper and lower U-shaped flanges extending lengthwise along a rear side of the front wall, rod end bracket means including a generally upright rod support panel member and a generally upright mounting panel, hinge means connecting one end of the rod support panel to one end of the mounting panel for pivotal movement relative thereto about a generally upright pivot axis between a position in which the support panel extends generally lengthwise of the mounting panel and a position in which the support panel extends at an angel to the mounting panel, the rod support panel having first and second sides and an upper rod support edge, said upper rod support edge being constructed and arranged to extend into the upper flange on the rod section adjacent one end thereof and support the rod section for pivotal movement about the upper edge toward and away from the rod support panel, latch means on the rod support panel spaced below the upper rod support edge and engageable with the rod section when the latter is pivoted above the upper rod support edge into engagement with the rod support panel for releasably retaining the rod section against pivotal movement away from the rod support panel, wall bracket means for attaching the mounting panel to a support, said mounting panel having first and second side edges and said wall bracket means being adapted to attach the mounting panel to a support with either said first or said second side edge of the mounting panel uppermost, said hinge means being constructed and arranged for connecting the support panel to the mounting panel with the upper rod support edge of the support panel uppermost, when either said first or said second side edge of the mounting panel is uppermost, said rod section having a latch opening in the front wall spaced below the upper flange and inwardly of one end of the rod section, said latch means including first and second latch members integral with the support panel respectively at the first and second sides thereof and spaced below the upper edge of the support panel a distance to extend through the latch opening when the rod section is respectively contiguous to the first or the second side of the support panel.

3. A curtain rod and bracket assembly comprising, at least one elongated rod section having a front wall and upper and lower U-shaped flanges extending lengthwise along a rear side of the front wall, rod end bracket means including a generally upright rod support panel member and a generally upright mounting panel, hinge means connecting one end of the rod support panel to one end of the mounting panel for pivotal movement relative thereto about a generally upright pivot axis between a position in which the support panel extends generally lengthwise of the mounting panel and a position in which the support panel extends at an angle to the mounting panel, the rod support panel having first and second sides and an upper edge, said upper edge being constructed and arranged to extend into the upper flange on the rod section adjacent one end thereof and support the rod section for pivotal movement about the upper edge toward and away from the rod support panel, latch means on the rod support panel spaced below the upper edge and engageable with the rod section when the latter is pivoted about the upper edge into engagement with the rod support panel for releasably retaining the rod section against pivotal movement away from the rod support panel, wall bracket means for attaching the mounting panel to a support, said wall bracket means including a generally upright bracket plate and an integral mounting flange extending laterally from one end of the mounting plate, the bracket plate and mounting flange being formed of metal and the bracket plate being hand bendable relative to the mounting flange when the mounting flange is attached to a support for adjusting the angel of projection of the bracket plate relative to the mounting flange.

4. A curtain rod and bracket assembly comprising, at least one elongated rod section having a front wall and upper and lower U-shaped flanges extending lengthwise along a rear side of the front wall, rod end bracket means including a generally upright rod support panel member and a generally upright mounting panel, hinge means connecting one end of the rod support panel to one end of the mounting panel for pivotal movement relative thereto about a generally upright pivot axis between a position in which the support panel extends generally lengthwise of the mounting panel and a position in which the support panel extends at an angle to the mounting panel, the rod support panel having first and second sides and an upper edge, said upper edge being constructed and arranged to extend into the upper flange on the rod section adjacent one end thereof and support the rod section for pivotal movement about the upper edge toward and away from the rod support panel, latch means on the rod support panel spaced below the upper edge and engageable with the rod section when the latter is pivoted about the upper edge into engagement with the rod support panel for releasably retaining the rod section against pivotal movement away from the rod support panel, wall bracket means for attaching the mounting panel to a support, said wall bracket means including a generally upright bracket plate and a mounting flange at one end of the bracket plate, the bracket plate having parallel first and second edges and at least one row of spaced openings paralleling said first and second edges of the bracket plate, said mounting panel having an inner side adapted to overlie the bracket plate and first and second guide means at its inner side respectively engageable with the first and second side edges of the bracket plate, the mounting panel having a U-shaped slot therethrough intermediate said first and second guide means defining a tongue portion integrally joined only at one end to the mounting panel means and normally disposed generally coplanar with the mounting panel, the tongue portion having at least one boss extending from the distal end of the tongue portion at the inner side of the mounting panel for engagement with a selected opening in said row of openings, the bracket plate and the mounting flange being formed of one-piece metal and the bracket plate being hand bendable relative to the mounting flange when the mounting flange is attached to a support, for adjusting the angle of projection of the bracket plate relative to the mounting flange.

5. A curtain rod and bracket assembly comprising, at least one elongated rod section having a front wall and upper and lower U-shaped flanges extending lengthwise along a rear side of the front wall, rod end bracket means including a generally upright rod support panel of synthetic resin material and a generally upright mounting panel of synthetic resin material, hinge means connecting one end of the support panel to one end of the mounting panel for pivotal movement relative thereto about a generally upright pivot axis, wall bracket means for attaching the mounting panel to a support, the rod support panel being constructed and arranged to extend into and support one end of the rod section, the hinge means including a first hinge pintle integral with one of said panels and a first hinge knuckle integral with one other of said panels, the first hinge pintle, and first hinge knuckle being adapted for assembly by relative shifting of said panel members in a direction axially of the first hinge pintle, the hinge means including a second hinge pintle integral with one of said panels and a second hinge knuckle integral with one other of said panels, said second hinge knuckle including first and second knuckle sections having adjacent ends spaced apart a distance less than the diameter of the second hinge pintle and adapted for assembly on the second hinge pintle by relative movement of the panels in a direction radially of the second hinge pintle, when the first and second hinge pintle are assembled.

6. A curtain rod and bracket assembly comprising, at least one elongated rod section having a front wall and upper and lower U-shaped flanges extending lengthwise along a rear side of the front wall, rod end bracket means including a generally upright rod support panel of synthetic resin material and a generally upright mounting panel of synthetic resin material, hinge means connecting one end of the support panel to one end of the mounting panel for pivotal movement relative thereto about a generally upright pivot axis, wall bracket means for attaching the mounting panel to a support, the rod support panel having side edges and being constructed and arranged to extend into and support one end of the rod section, the hinge means including a first hinge pintle integral with said mounting panel and a first hinge knuckle integral with said support panel, the first hinge pintle and first hinge knuckle being adapted for assembly by relative shifting of said panels in a direction axially of the first hinge pintle, the hinge means including a second hinge pintle integral with said mounting panel and a second hinge knuckle integral with said support panel, said second hinge knuckle including first and second knuckle sections having adjacent ends spaced apart a distance less than the diameter of the second hinge pintle and adapted for assembly on the second hinge pintle by relative movement of the panels in a direction radially of the second hinge pintle, when the first and second hinge pintles are assembled.

7. A curtain rod and bracket assembly according to claim 6 wherein said mounting panel has first and second side edges and said wall bracket means is adapted to attach the mounting panel to a support with either said first or said second side edge of the mounting panel uppermost, said hinge means being constructed and arranged for connecting the support panel to the mounting panel with one side edge of the support panel adjacent the level of the uppermost side edge of the mounting panel.

8. A curtain rod and bracket assembly comprising, at least one straight curtain rod section having a front wall and upper and lower U-shaped flanges extending lengthwise along a rear side of the front wall, rod end bracket means including a generally upright rod support panel of synthetic resin material and a generally upright mounting panel of synthetic resin material, hinge means connecting one end of the support panel to one end of the mounting panel for pivotal movement relative thereto about a generally upright pivot axis, the mounting panel having parallel first and second side edges, wall bracket means for attaching the mounting panel to a support with either the first or the second side edge of the mounting panel uppermost, the rod support panel having first and second side edges and constructed and arranged to extend into and support one end of the rod member, the hinge means including a first and second hinge pintle means integral with said mounting panels respectively adjacent the first and second side edges of the mounting panel member and first and second hinge knuckles integral with said support panel respectively adjacent the first and second side edges of the support panel, the first hinge knuckle being adapted for assembly on the first pintle means when the first side edge of the mounting panel is uppermost and on the second hinge pintle means when the second side edge of the mounting panel is uppermost, by relative shifting of said panels in a direction axially of the hinge pintles, the second hinge knuckle including first and second knuckle sections having adjacent ends spaced apart a distance less than the diameter of the first and second hinge pintle means and adapted for assembly on the second hinge pintle means when the first side edge of the mounting panel is uppermost and on the first hinge pintle means when the second side edge of the mounting panel is uppermost, by relative movement of the panels in a direction radially of the second hinge pintle.

9. A curtain rod and bracket assembly for bay and bow window installations comprising, at least two rod sections in endwise adjacent relation, first and second wall bracket means, first and second rod end bracket means, and at least one rod connector means, each rod section having a front wall and upper and lower U-shaped flanges along a rear side of the front wall, the rod connector means including two panel portions extending into adjacent ends of endwise adjacent rod sections and means connecting the panel portions for relative pivotal movement about a generally upright axis, the wall bracket means each including a generally upright bracket plate and an integral mounting flange extending laterally from one end of the bracket plate, the bracket plate and mounting flange being formed of metal and the bracket plate being hand bendable relative to the mounting flange when the mounting flange is attached to a support to adjust the angle of projection of the bracket plate relative to the mounting flange, the rod end bracket means each including (a) a generally upright mounting panel mounted on the bracket plate for adjustment toward and away from the mounting flange, (b) a rod support panel arranged to extend into and support one end of one of the rod sections, and (c) hinge means connecting one end of the support panel to one end of the mounting panel for pivotal movement relative thereto about a generally upright hinge axis to enable adjustment of the angle at which a rod support panel extends from the mounting panel.

10. A curtain rod and bracket assembly according to claim 9 wherein said first and second wall bracket means are of like configuration, the mounting panels of the first and second rod end bracket means being of like configuration, the rod support panels of the first and second mounting panels being of like configuration.

11. A curtain rod and bracket assembly according to claim 9 wherein said rod connector means is formed of a resilient synthetic resin material and said panel portions each have first and second side edges spaced apart to be received in upper and lower flanges on a respective one of the rod sections, each panel portion of the rod connector means having an area recessed below the first side edge and a tab disposed in said recessed area and integrally joined at one end to the associated panel portion, the tab having a distal end normally projecting above the first edge of the associated panel portion for resiliently engaging a flange on an associated rod section.

12. A curtain rod and bracket assembly according to claim 11 wherein the means connecting the panel portions for relative pivotal movement comprises an intermediate portion of said resilient synthetic material integrally joined to the two panel portions and sufficiently thin to allow flexing of the panel portions relative to each other.

13. A curtain rod and bracket assembly for bay and bow window installations comprising, at least two rod sections in endwise adjacent relation, first and second wall bracket means, first and second rod end bracket means, and at least one rod connector means, each rod section having a front wall and upper and lower U-shaped flanges along a rear side of the front wall, the rod connector means including two panel portions extending into adjacent ends of endwise adjacent rod sections and means connecting the panel portions for relative pivotal movement about a generally upright axis, said rod connector means being formed of a resilient synthetic resin material and said panel portions each having first and second side edges spaced apart to be received in the upper and lower flanges on a respective one of the rod sections, each panel portion of the rod connector means having an area recessed below the first side edge and a tab disposed in said recessed area and integrally joined at one end to the associated panel portion, the tab having a distal end normally projecting above the first edge of the associated panel portion for resiliently engaging a flange on an associated rod section.

14. A curtain rod and bracket assembly comprising, at least two rod sections in endwise adjacent relation, first and second wall bracket means, first and second rod end bracket means, and at least one rod connector means, each rod section having a front wall and upper and lower U-shaped flanges along a rear side of the front wall, the rod connector means including two panel portions extending into adjacent ends of endwise adjacent rod sections, said rod connector means being formed of a resilient synthetic resin material and said panel portions each having first and second side edges spaced apart to be received in the upper and lower flanges on a respective one of the rod sections, each panel portion of the rod connection means having an area recessed below the first side edge and a tab disposed in said recessed area and integrally joined at one end to the associated panel portion, the tab having a distal end normally projecting above the first edge of the associated panel portion for resiliently engaging a flange on an associated rod section.

* * * * *

UNITED STATES PATENT AND TRADEMARK OFFICE

CERTIFICATE OF CORRECTION

PATENT NO. : 5,018,626

DATED : May 28, 1991

INVENTOR(S) : Daniel C. Johnson

It is certified that error appears in the above-identified patent and that said Letters Patent is hereby corrected as shown below:

Claim 2, column 6, line 42, "angel" should be -- angle --;

Claim 3, column 7, line 38, "angel" should be -- angle --;

Claim 14, column 12, line 1, "connection" should be -- connector --.

Signed and Sealed this

Seventeenth Day of November, 1992

*Attest:*

DOUGLAS B. COMER

*Attesting Officer*

*Acting Commissioner of Patents and Trademarks*